US010251501B2

(12) United States Patent
Capobianco

(10) Patent No.: US 10,251,501 B2
(45) Date of Patent: Apr. 9, 2019

(54) SUPPORT APPARATUS FOR HOLDING AND TRANSPORTING BEVERAGE GLASSES, AND METHOD OF USING SAME

(71) Applicant: Karl Capobianco, Sterling Heights, MI (US)

(72) Inventor: Karl Capobianco, Sterling Heights, MI (US)

( * ) Notice: Subject to any disclaimer, the term of this patent is extended or adjusted under 35 U.S.C. 154(b) by 0 days.

(21) Appl. No.: 15/693,622

(22) Filed: Sep. 1, 2017

(65) Prior Publication Data

US 2018/0055260 A1 Mar. 1, 2018

Related U.S. Application Data

(60) Provisional application No. 62/382,370, filed on Sep. 1, 2016.

(51) Int. Cl.
*A47G 23/02* (2006.01)
*A47G 23/06* (2006.01)

(52) U.S. Cl.
CPC ..... *A47G 23/0208* (2013.01); *A47G 23/06* (2013.01)

(58) Field of Classification Search
CPC ..... A47G 23/0208; A47G 23/0241; A47G 23/06; B65D 71/50; B25J 15/0014
USPC ..... 294/15, 23.5, 27.1, 55.5, 87.28, 91, 137, 294/145, 5.5, 9, 32
See application file for complete search history.

(56) References Cited

U.S. PATENT DOCUMENTS 2,294,903 A 9/1942 Griffin
2,420,191 A * 5/1947 Ransom ..... B65D 71/50 294/87.28
2,508,945 A 5/1950 Heuer
2,905,502 A * 9/1959 Brown ..... B65D 71/50 206/431
3,023,043 A * 2/1962 Ragains ..... A47J 45/10 294/31.1
3,049,337 A * 8/1962 Griggs ..... E04G 23/08 254/131
3,078,020 A * 2/1963 Boonstra ..... A01G 9/088 211/74
4,037,766 A * 7/1977 Iacono ..... B65D 71/50 206/160
4,515,104 A * 5/1985 Lee ..... B05C 13/02 118/500
4,530,343 A * 7/1985 Beck ..... A47J 37/0768 126/25 R (Continued)

*Primary Examiner* — Dean J Kramer
(74) *Attorney, Agent, or Firm* — Carrier Blackman & Associates, P.C.; William D. Blackman; Joseph P. Carrier

(57) ABSTRACT

A beverage glass transport apparatus holds and transports multiple beverage glasses, each having a narrow base portion and a wider upper portion. The apparatus includes a unitary fork body with two spaced apart arms defining a slot therebetween, with an opening at one end of the fork body. Optionally, each arm may include an inner band and an outer band joined to the inner band. The inner bands have upper surfaces which cooperate to define a plane. Each of the outer bands extends in a direction away from the plane, which may be downwardly. The fork body also includes a bridge interconnecting the arms, the bridge disposed at an end of the fork body opposite the opening. The fork body also includes a handle attached to the bridge portion, for being grasped by a user to carry the apparatus. A method of using the apparatus to transport beverages is also described.

6 Claims, 16 Drawing Sheets

(56) References Cited

U.S. PATENT DOCUMENTS

| | | | | |
|---|---|---|---|---|
| 4,623,185 | A | 11/1986 | Thomas | |
| 5,899,515 | A | 5/1999 | Burns | |
| 5,941,584 | A * | 8/1999 | Young | A47J 37/0786 294/15 |
| 6,964,443 | B1 | 11/2005 | Newton | |
| 7,270,356 | B2 * | 9/2007 | Roderick | B25B 9/00 294/211 |
| D576,455 | S * | 9/2008 | Siddle | D7/701 |
| 8,272,506 | B1 | 9/2012 | Flannery et al. | |
| 8,727,405 | B2 * | 5/2014 | Cameron | B25J 1/00 294/16 |
| 2009/0230065 | A1 * | 9/2009 | Wax | A47G 23/0208 211/60.1 |
| 2010/0194129 | A1 * | 8/2010 | Bouthiette | B65G 59/023 294/55.5 |
| 2015/0366334 | A1 * | 12/2015 | Marney | A47G 23/0208 294/143 |

* cited by examiner

PRIOR ART

SUPPORT APPARATUS FOR HOLDING AND TRANSPORTING BEVERAGE GLASSES, AND METHOD OF USING SAME

CROSS-REFERENCE TO RELATED APPLICATIONS

The present application claims priority under 35 U.S.C. 119(e), based on U.S. provisional patent application 62/382,370, filed Sep. 1, 2016. The entire disclosure of this priority document, including specification, claims, and drawings, is incorporated by reference herein.

BACKGROUND OF THE INVENTION

1. Field of the Invention

The present invention relates to an apparatus for holding and transporting a plurality of beverage glasses, where each of the beverage glasses has a cylindrical base portion and an upper portion which is wider than the base portion, and also to a method of using the apparatus. More particularly, the present invention relates to an apparatus of the type described which is usable to hold and transport a plurality of drinking glasses, such as may be used for a flight of beverages, while the glasses are filled with liquid.

2. Description of the Background Art

A number of different support trays and devices are known for holding and transporting plural containers of beverages.

One example of a known support tray is shown in FIG. 15 of the drawings. The support tray of FIG. 15 may be used, for example, to transport a flight of several different sample beers in a bar or restaurant environment. However, the known support tray of FIG. 15 has a disadvantage, in that since each receptacle in the tray is formed as a separate opening in the plate, this tray design requires a user (server) to separately handle each glass during both loading and unloading thereof.

In some cases, this repeated individual contact of a server's hands with each glass may contribute to a possible transfer of germs on surfaces of the glasses. In addition, such repeated handling of each glass may, in some instances, increase the risk of an accident, such as either spillage or dropping of one or more glasses.

Other examples of known support devices for fluid containers include those shown and described in Kruea, U.S. Pat. No. 2,294,903, Heuer, U.S. Pat. No. 2,508,945, Thomas, U.S. Pat. No. 4,623,185, Burns, U.S. Pat. No. 5,899,515, Newton, U.S. Pat. No. 6,964,443, and Flannery, U.S. Pat. No. 8,272,506.

Although the known beverage support trays and related devices are usable for their intended purposes, a need still exists in the art for a simple, yet effective support apparatus for holding and transporting beverage glasses, and to a method of using such support apparatus. In particular, there is a need for an improved apparatus as described, which is stackable with other identical support apparatus, and which is configured to fit easily into a dishwasher.

In addition, there is a need for a beverage support apparatus, and method of using the apparatus, which allows a user or server to easily pick up, transport and deliver a plurality of beverage glasses to a destination table or countertop, while minimizing the need for the user or server to separately and individually handle each glass, thereby minimizing the user or server's physical contact with the glasses.

SUMMARY OF THE INVENTION

The present invention provides a beverage glass transport apparatus for use in holding and transporting multiple beverage glasses, in which each of the glasses includes a narrow base portion and a wider upper portion.

A beverage glass transport apparatus according to the present invention is configured to fit easily into, and to be effectively cleaned by a dishwasher.

A beverage glass transport apparatus according to the present invention is stackable with other identical beverage caddies, so that multiple caddies can be stored in a compact space.

In addition, a beverage glass transport apparatus according to the present invention allows a user to easily pick up, transport and deliver a plurality of beverage glasses to a destination table or countertop, while minimizing the need for a user to separately and individually handle each glass.

A beverage glass transport apparatus according to the present invention is configured for holding and transporting a plurality of beverage glasses, where each of the glasses includes a narrow middle or base portion and an upper portion which is wider than the narrow portion. These glasses may be wine glasses, soda or soft drink glasses, juice glasses, or small tumblers such as those used for a sample flight of different beers, so long as they include an upper portion which is wider than a middle or base portion.

The beverage glass transport apparatus hereof may be made in any desired dimensions to correspond to the type and number of glasses to be transported.

The apparatus includes a unitary fork body having two spaced apart parallel arms with a slot defined therebetween, which provides an opening at one end of the fork body.

Each of the arms includes an inner band portion proximate the slot, and an outer band portion joined to a side edge of the inner band portion. The inner band portions are substantially flattened and have upper surfaces which cooperate to define a plane, and each of the outer bands extends in a direction away from the plane, which may be downwardly.

The fork body also includes a bridge portion integrally formed with and interconnecting the arms, at an end of the fork body substantially opposite the opening. The fork body also includes a handle integrally formed with the bridge portion and extending outwardly therefrom. The handle is configured to be grasped by a user to permit manipulation and carrying of the apparatus. In a particular embodiment of the invention, each of the second bands extends downwardly at an angle from a corresponding one of the first bands.

The present invention also relates to a method of holding and transporting a plurality of beverage glasses, where each of the beverage glasses has a narrow base portion, an upper portion which is wider than the base portion, and a flat bottom surface.

The method includes a first step of placing the beverage glasses substantially in a row.

The method includes a second step of sliding the arms of the described apparatus past the base portions of the beverage glasses in a manner so as to successively receive the base portions in the slot between the arms, via the opening, until all of the beverage glasses are situated in the slot and between the arms of the apparatus.

The method then includes another step of lifting the apparatus and the beverage glasses together, with the beverage glasses disposed in the slot.

The method then includes another step of moving the apparatus and beverage glasses to a desired destination.

The method then includes another step of placing the beverage glasses on a flattened, substantially horizontal destination surface with the bottom surfaces of the beverage glasses contacting the destination surface.

The method then includes a final step of slidably pulling the apparatus away from the beverage glasses, in a manner so as to successively release the beverage glasses out of the slot via the opening.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 7 is a top plan view of the beverage glass transport apparatus of FIG. 3, the bottom plan view being similar.

DETAILED DESCRIPTION OF ILLUSTRATIVE EMBODIMENTS

Figure 1:
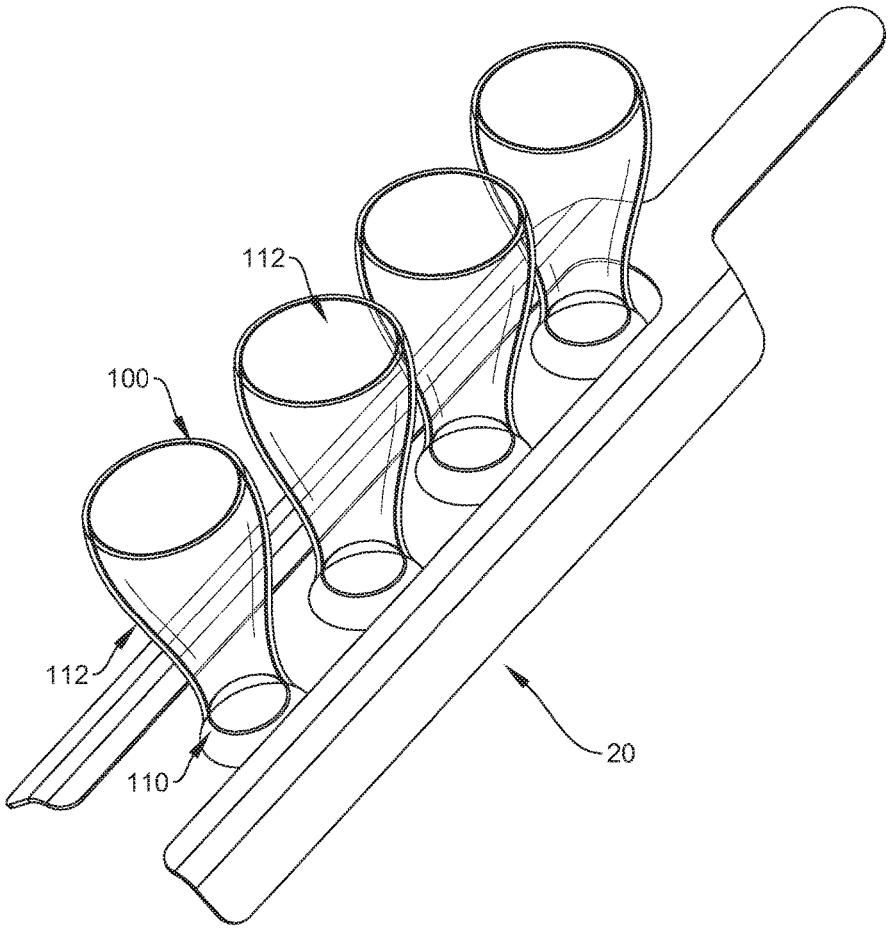
FIG. 1 is a first environmental perspective view of a beverage glass transport apparatus according to a first illustrative embodiment of the present invention, shown lying flat on a substrate with a plurality of beverage glasses therein, with the glasses lined up in a row.
Figure 2:
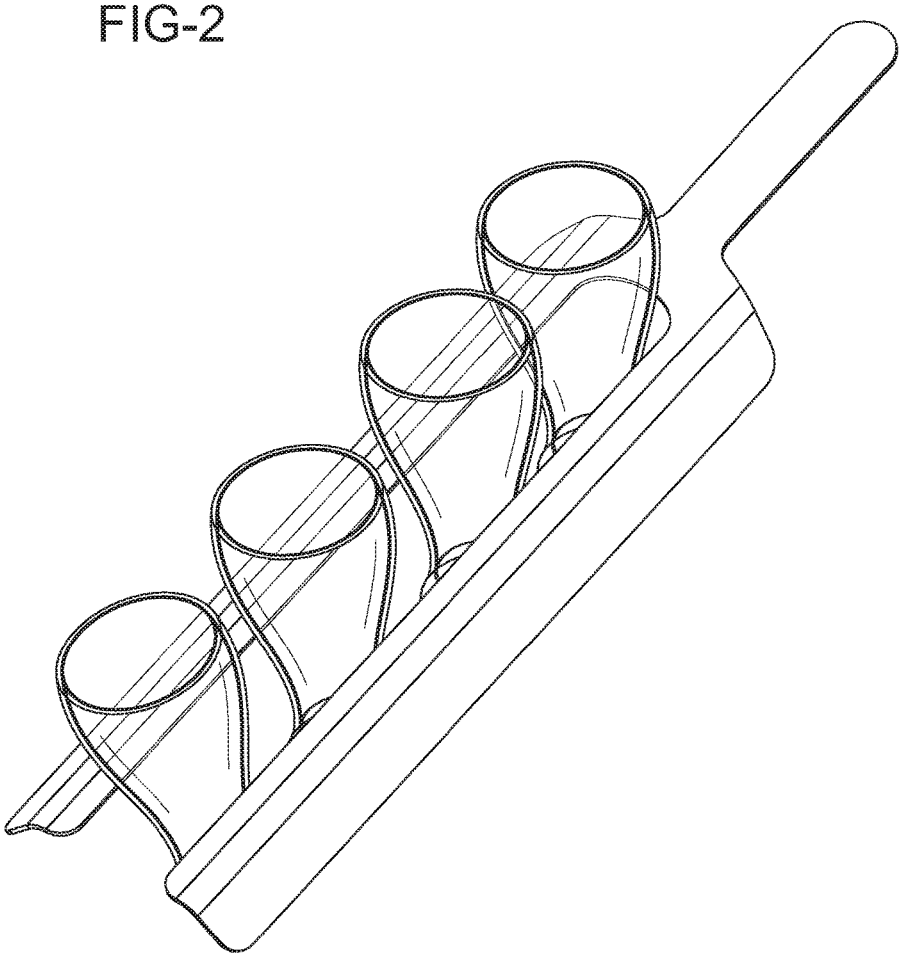
FIG. 2 is a second environmental perspective view of the beverage glass transport apparatus and beverage glasses of FIG. 1, shown elevated and preparing to pick up and transport the beverage glasses.
Figure 3:
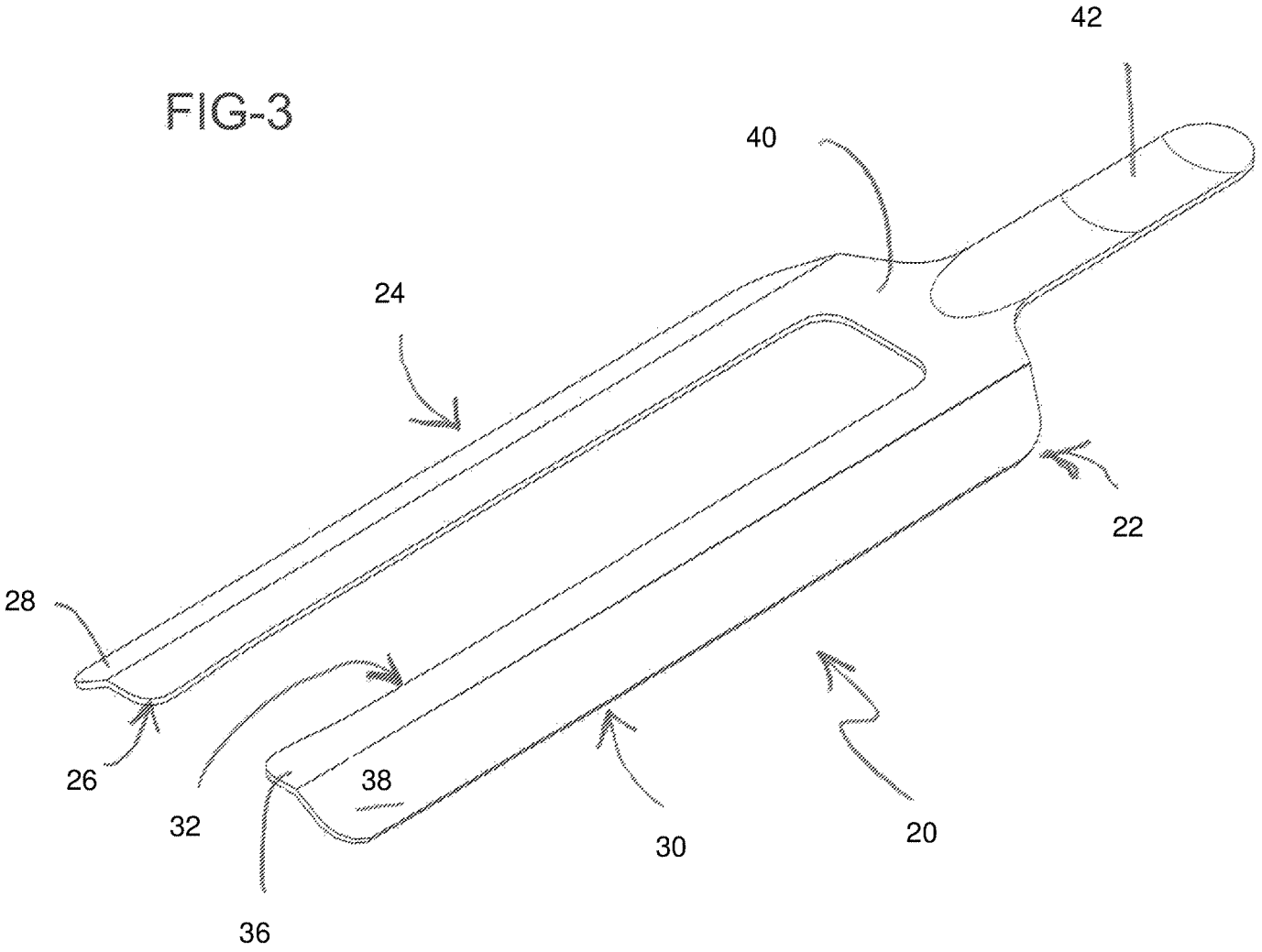
FIG. 3 is a first perspective view of a second embodiment of the beverage glass transport apparatus, in which the handle is slightly curved, viewed from a first vantage point.

Referring now to FIGS. 1-3 of the drawings, the present invention provides a beverage glass transport apparatus 20 for use in holding and transporting multiple beverage glasses 100, in which each of the glasses includes a narrow base or medial portion 110 and an upper portion 112 which is wider than the narrow portion. These glasses may be wine glasses, soda or soft drink glasses, juice glasses, or small tumblers such as those used for individual portions in a sample flight of different beers, so long as they include an upper portion which is wider than a middle or base portion.

As shown in FIG. 1, a beverage glass transport apparatus 20 according to a first illustrative embodiment of the present invention is shown lying flat on a substrate with a plurality of identical beverage glasses 100 lined up in a row and situated in a central slot 32 of the generally fork-shaped apparatus. Each of the beverage glasses 100 includes a narrow base portion 110, and a wider upper portion 112.

FIG. 2 is a second environmental perspective view of the beverage glass transport apparatus 20 and glasses 100 of FIG. 1, shown elevated and preparing to pick up and transport the beverage glasses.

The beverage glass transport apparatus hereof may be made in any desired dimensions, including length, to correspond to the type and number of glasses to be transported.

The beverage glass transport apparatus 20 according to the present invention is configured to fit easily into, and to be effectively cleaned by an automatic dishwasher (not shown). The beverage glass transport apparatus 20 according to the present invention is stackable with other identical units, so that multiple apparatus can be stored in a compact space.

In addition, the beverage glass transport apparatus 20 according to the present invention allows a user to easily pick up, transport and deliver a plurality of beverage glasses 100 to a destination table or countertop, while minimizing the need for a server or user to separately and individually handle each glass.

Figure 4:
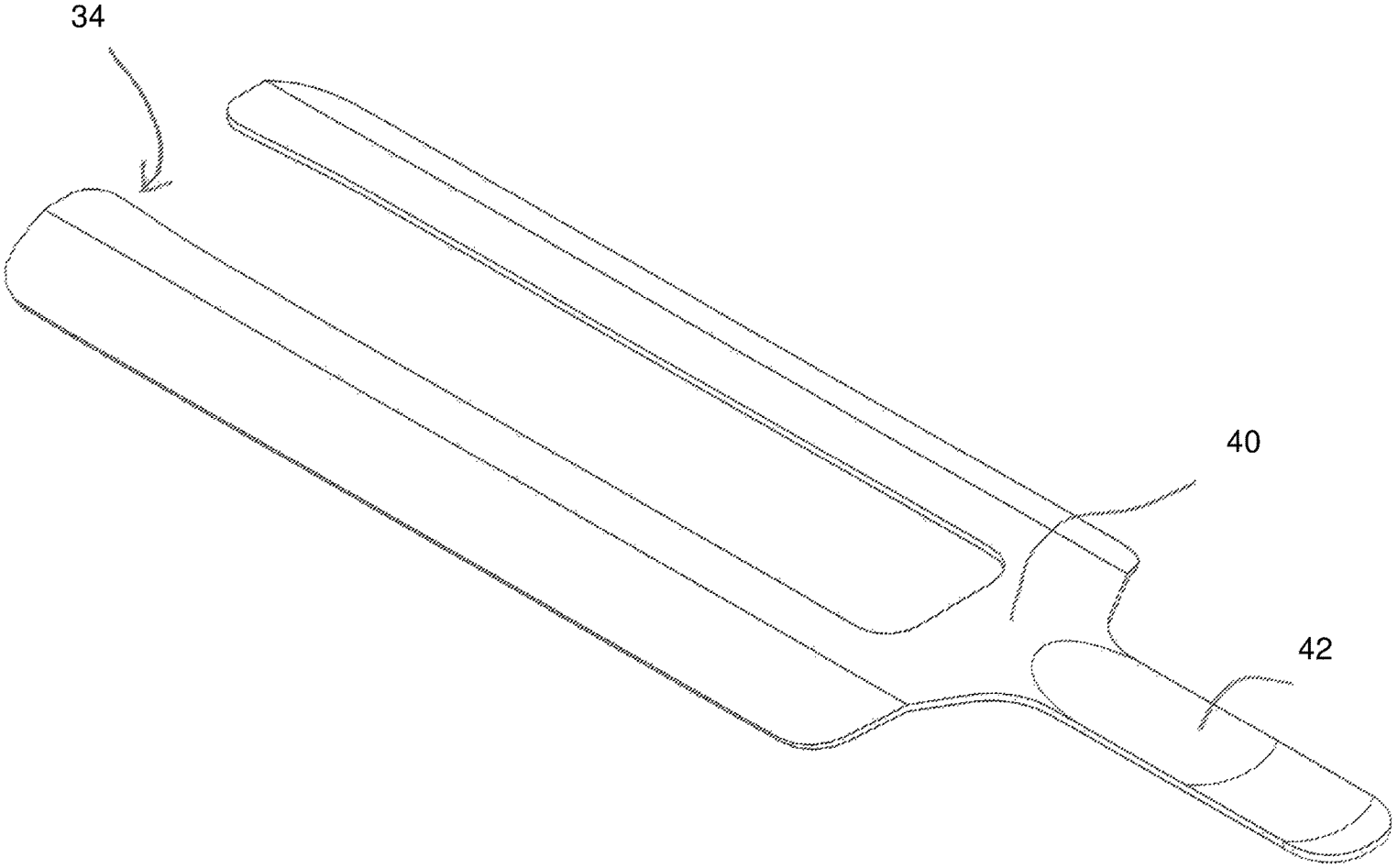
FIG. 4 is a second perspective view of the beverage glass transport apparatus of FIG. 3, viewed from a second vantage point.
Figure 5:
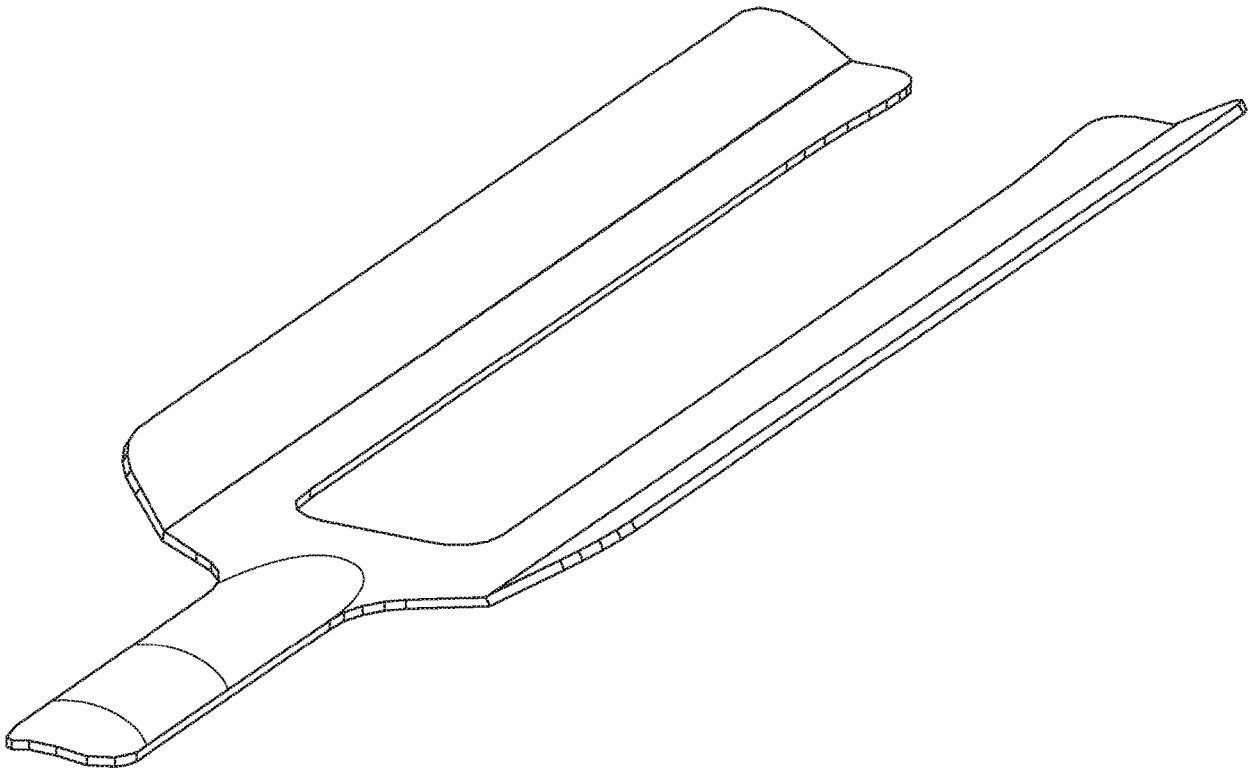
FIG. 5 is a third perspective view of the beverage glass transport apparatus of FIG. 3, shown inverted and viewed from a first vantage point.
Figure 6:
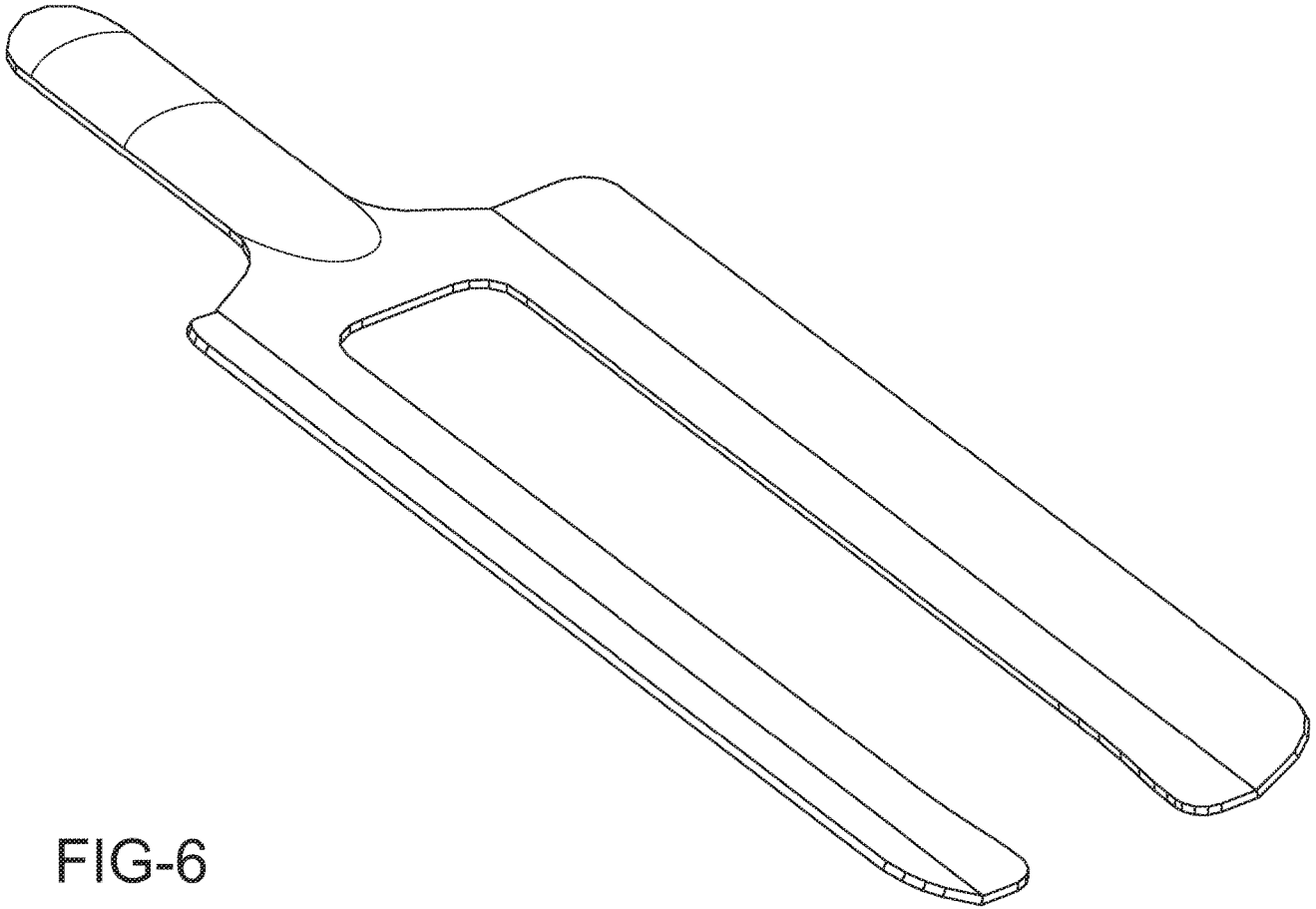
FIG. 6 is a fourth perspective view of the beverage glass transport apparatus of FIG. 3, shown inverted and viewed from a second vantage point.

Referring also to FIGS. 3 and 4, the apparatus 20 includes a unitary fork body 22 having two spaced-apart parallel arms 24, 30 with a central slot 32 defined therebetween, which provides an opening 34 at a distal end of the fork body. Each of the arms 24, 30 has an outer edge, in a lateral direction, which is disposed at a first height and which is configured to contact a flattened support surface such as a table when placed thereon. Each of the arms 24, 30 also has an inner edge in the lateral direction, which is disposed at a second height above the first height. The slot 32 formed between the arms 24, 30 has a width corresponding to a diameter of the beverage glasses 100 to be transported. In other words, the slot is slightly wider than the diameter of the glasses 100 at the medial portion 110 thereof, but narrower than the diameter of the glasses at the upper portion 112 thereof. As a result of such width of the slot, when elevated with glasses 100 disposed in the slot 32, the apparatus 20 will lift and support the glasses, as shown in FIG. 2.

Each of the arms 24, 30 includes an inner band portion 26, 36, respectively, proximate the slot, and an outer band portion 28, 38 joined to a side edge of the inner band portion. The inner band portions 26, 36 are substantially flattened and have upper surfaces which cooperate to define a plane, and each of the outer band portions 28, 38 extends in a direction away from the plane, which direction may be downwardly, as shown. In the depicted embodiment of the invention, each of the outer band portions 28, 38 extends downwardly at an angle from a corresponding one of the inner band portions 26, 36.

Figure 7:
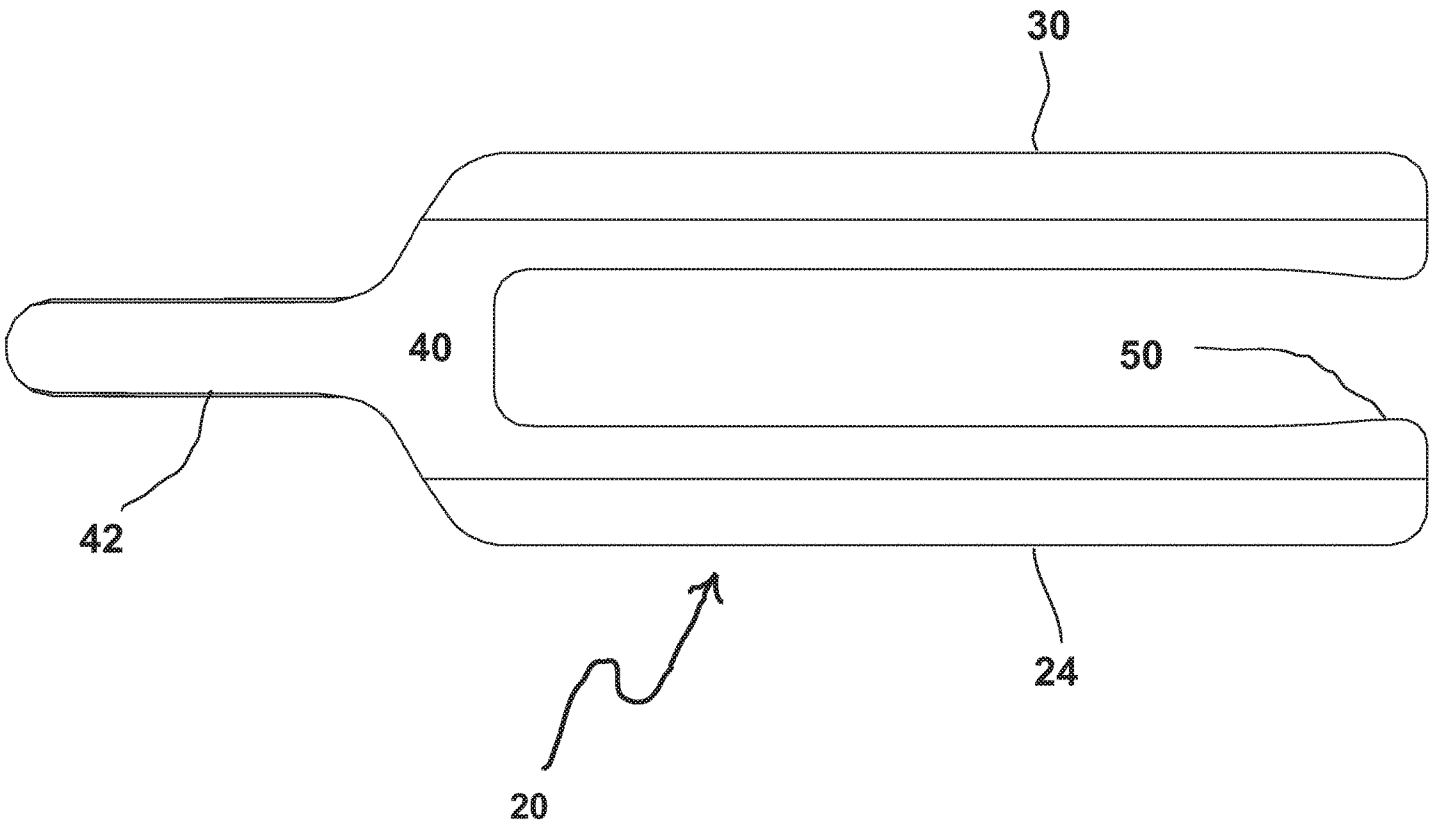
Figure 8:
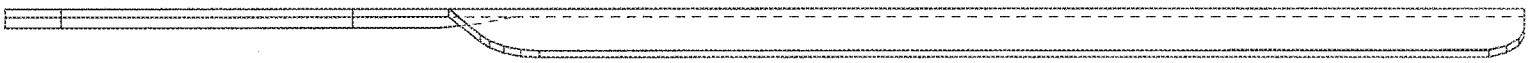
FIG. 8 is a right side plan view of the beverage glass transport apparatus of FIG. 3, with the opposite side view being a mirror image thereof.
Figure 9A:
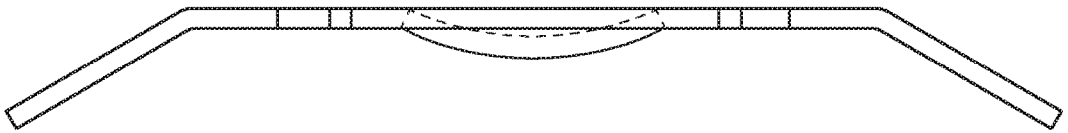
FIG. 9A is a distal end plan view of the beverage glass transport apparatus of FIG. 3.
Figure 9B:
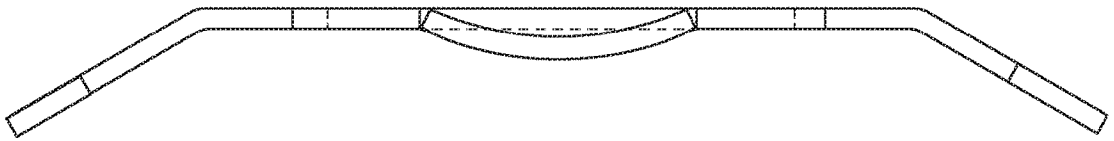
FIG. 9B is a proximal, or handle end plan view of the beverage glass transport apparatus of FIG. 3.

Optionally, as shown in FIG. 7, each of the arms 24, 30 may have a widened portion formed by a protuberance 50 extending laterally inwardly at a distal end portion thereof, effectively narrowing the width of the slot 32 at the opening 34, to help maintain the glasses 100 in the slot during use.

Although the outer band portions 28, 38 are shown as substantially flattened platelike members, they may be formed in any desired shape, such as with a curved cross-section.

Figure 10:
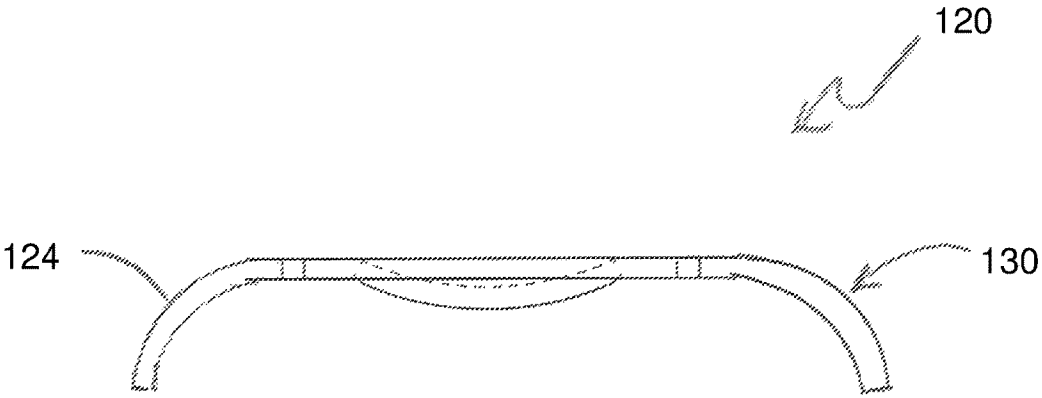
FIG. 10 is a distal end plan view of the beverage glass transport apparatus according to a modified embodiment.

Alternatively, if desired, in a modified embodiment of the apparatus 120 shown in FIG. 10, each of the arms 124, 130 may be formed with a continuously curved cross-sectional shape, extending outwardly and downwardly from the slot 32.

The fork body 22 also includes a bridge portion 40 integrally formed with and interconnecting the arms 24, 30, at a handle end of the fork body substantially opposite the opening 34.

The fork body 22 also includes a handle 42 integrally formed with the bridge portion and extending outwardly therefrom, in a direction away from the arms 24, 30. The handle 42 is configured to be grasped by a user, as shown in FIG. 2, to permit manipulation and carrying of the apparatus. If desired, the handle 42 may be provided with grippable padding, such as a sleeve made with padded fabric, rubber or an elastomeric material thereon.

The beverage glass transport apparatus 20 is shown in a number of different orientations and from a number of different vantage points in FIGS. 5-8 and 9A-9B to provide a better understanding of the structure thereof.

Figure 11:
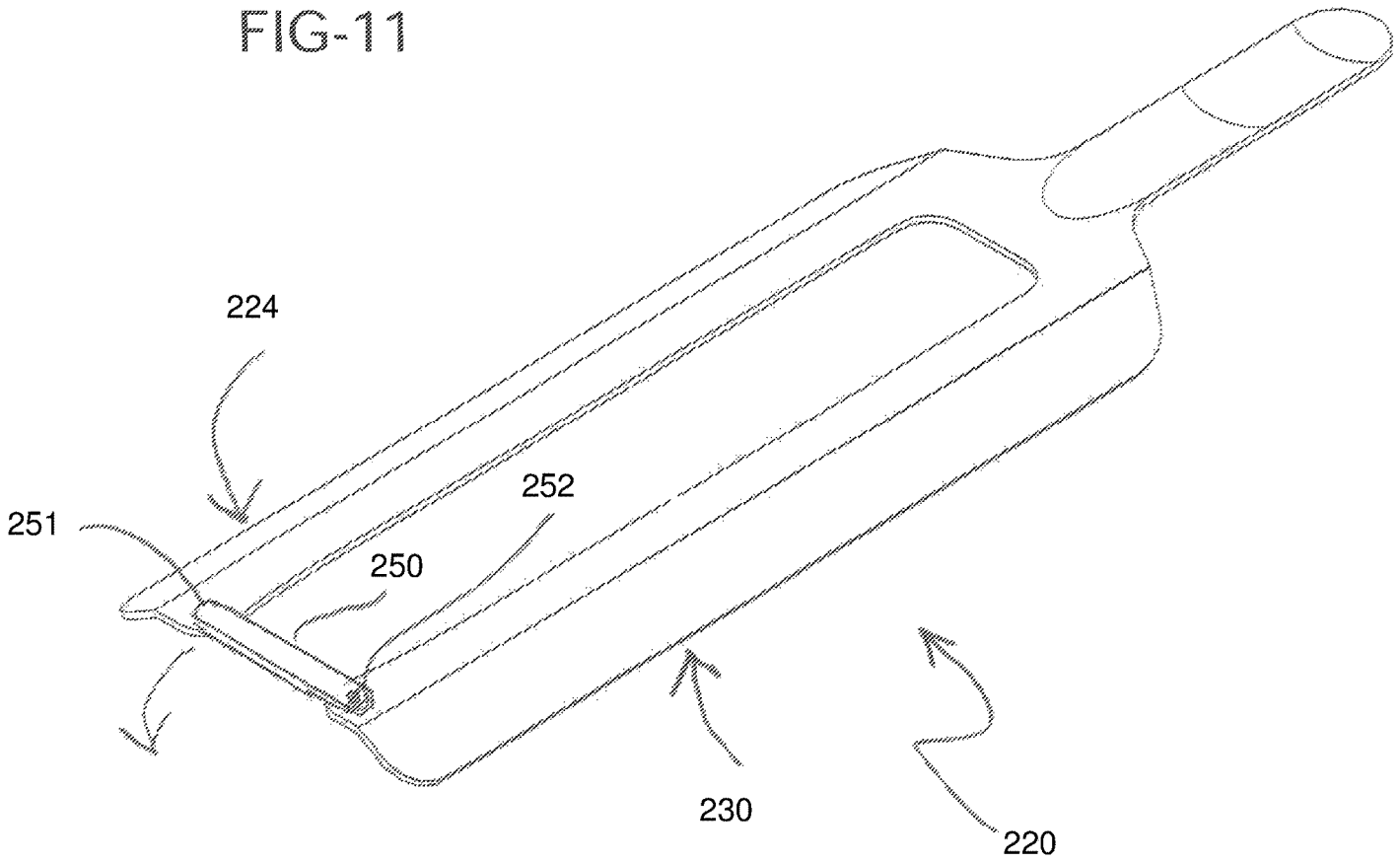
FIG. 11 is a perspective view of a third embodiment of the apparatus.

Referring now to FIG. 11, another modified embodiment of the apparatus 220 is shown. The embodiment 220 of FIG. 11 is identical to the apparatus 20 of FIG. 3, except that this embodiment further includes the addition of an optional, pivotally movable latch member 250 which is pivotally mounted to a tip end of one of the arms 230 using a pivot fastener 252, as shown. The latch member 250 may be opened by pivotally moving a free end 251 of the latch member in the direction of the arrow in FIG. 11.

In the embodiment of the apparatus 220 shown in FIG. 11, the tip end of the other arm 224 may be provided with structure which creates an interference fit between the arm 224 and the free end 51 of the latch member 50 opposite the pivot fastener 52, permitting the latch member to be temporarily and releasably locked in place in the closed position shown in the drawing, in order to reduce any likelihood of losing one or more of the beverage glasses 100 during transport thereof.

The present invention also relates to a method of holding and transporting a plurality of beverage glasses 100, where each of the beverage glasses has a narrow base portion 110, an upper portion 112 which is wider than the base portion, and a flat bottom surface.

Figure 12:
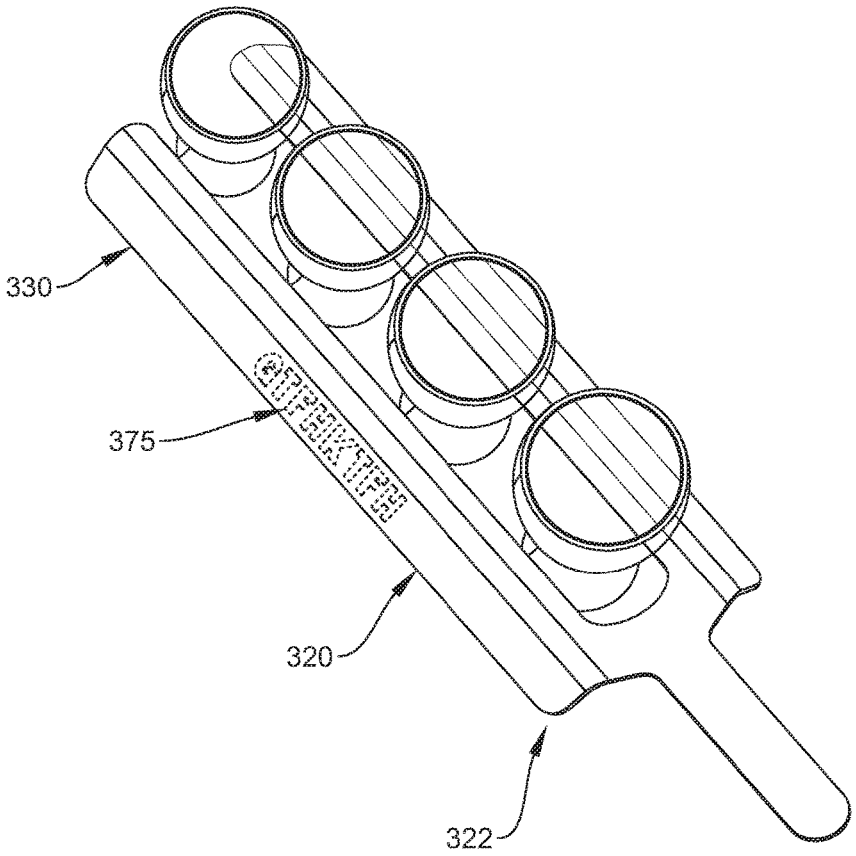
FIG. 12 is a first environmental perspective view of a fourth embodiment of the apparatus, shown lying flat on a substrate with a plurality of beverage glasses therein, with the glasses lined up in a row.
Figure 13:
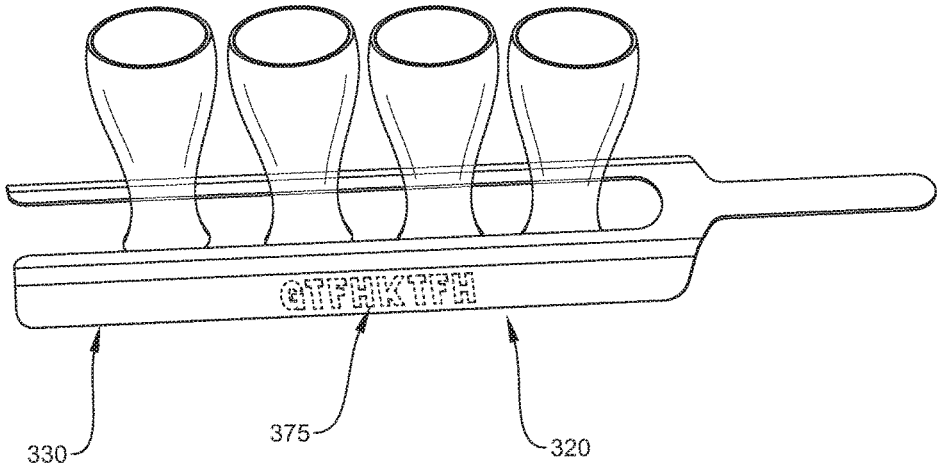
FIG. 13 is a second environmental perspective view of the embodiment of FIG. 12.

Referring now to FIGS. 12-13, another modified embodiment of the apparatus 320 is shown. The embodiment 220 of FIG. 11 is identical to the apparatus 20 of FIG. 3, except that this embodiment further includes the addition of advertising indicia 375 somewhere on the fork body 322. The advertising indicia 375 may include a brand, a logo, a telephone number, a website Uniform Resource Locator (URL) indicating a website location, and/or other desired indicia. Where used, the advertising indicia 375 may be placed in any desired location on the fork body 322, including the arms, the bridge, and the handle.

Method of Use

Figure 14:
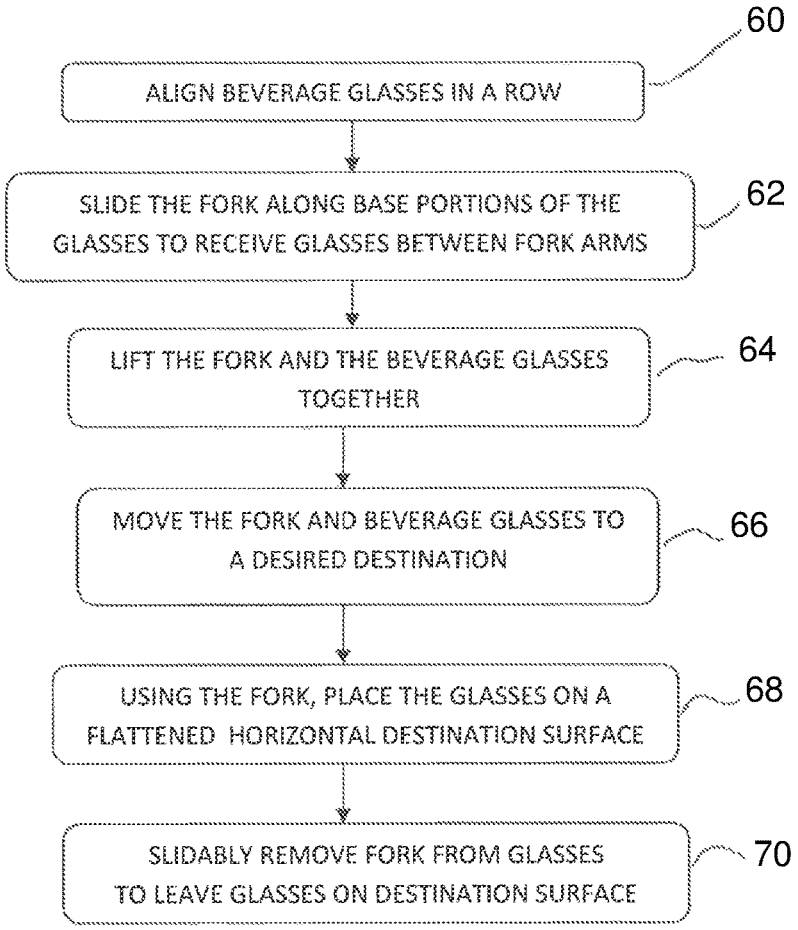
FIG. 14 is a flowchart showing steps in a method according to the present invention.
Figure 15:
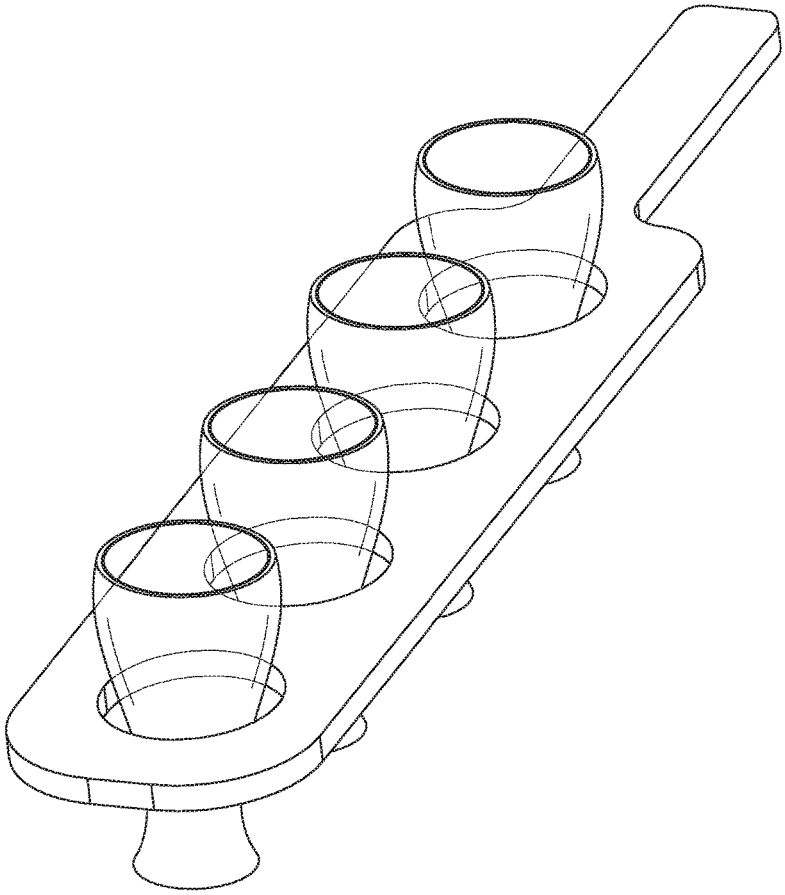
FIG. 15 is an environmental perspective view of a prior art beverage glass transport apparatus holding a plurality of beverage glasses.

FIG. 14 is a flowchart showing step in a method according to the present invention. In the flowchart of FIG. 14, the word "fork" has been substituted in place of the phrase "beverage glass transport apparatus" in the interest of brevity. The word "fork" in FIG. 14 should be read as being equivalent to the phrase "beverage glass transport apparatus" as used elsewhere in the present specification.

The method includes a first step of aligning the beverage glasses 100 substantially in a row, similar to the arrangement shown in FIGS. 1-2 on a first flat surface such as a table or countertop. This step is shown at 60 in FIG. 14.

The method includes a second step of sliding the arms 24, 30 of the described apparatus 20 past the base portions of the beverage glasses 100 in a manner so as to successively receive the base portions of the glasses in the slot 32 between the arms, via the opening 34, until all of the beverage glasses 100 are disposed in the slot 32 and between the arms 24,30 of the apparatus 20. This step is shown at 62 in FIG. 14, and is illustrated in FIG. 1.

The method then includes another step of lifting the apparatus 20 and the beverage glasses 100 together, with the beverage glasses disposed in the slot 32. This step is shown at 64 in FIG. 14, and is illustrated in FIG. 2.

The method then includes another step of and moving the apparatus 20 and beverage glasses 100 together as a unit to a desired destination. This step is shown at 66 in FIG. 14.

The method then includes another step of placing the beverage glasses 100 on a flattened, substantially horizontal destination surface (not shown) with the bottom surfaces of the beverage glasses contacting the destination surface. This step is shown at 68 in FIG. 14.

The method then includes a final step of slidably pulling the apparatus 20 away from the beverage glasses 100, in a manner so as to successively release the beverage glasses out of the slot 32 via the opening 34. This step is shown at 70 in FIG. 14.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A beverage glass transport apparatus for holding and transporting a plurality of beverage glasses where each of the beverage glasses includes a narrow base portion and an upper portion which is wider than the base portion, said apparatus comprising a unitary fork body comprising:

two spaced apart parallel arms with a slot defined therebetween which provides an opening at a distal end of the fork body, said slot having a width corresponding to a diameter of the beverage glasses to be transported, each of the arms having an outer edge, in a lateral direction, which is disposed at a first height and which is configured to contact a flattened support surface when placed thereon, and an inner edge in the lateral direction, which is disposed at a second height above the first height;

a bridge portion joining the arms together and being integrally formed therewith, the bridge portion disposed at a handle end of the fork body substantially opposite the opening; and a handle formed integrally with the bridge portion and extending outwardly therefrom in a direction away from the opening, the handle configured to be grasped by a user to permit manipulation and carrying of the apparatus;

wherein each of the arms comprises an inner band proximate the slot, the inner bands being substantially flattened and having upper surfaces which cooperate to define a plane, and an outer band joined to the inner band and extending in a direction away from said plane.

2. The apparatus of claim 1, wherein in a primary use orientation of the apparatus, each of the arms includes a laterally inner portion disposed at a first level, and a laterally outer portion which is disposed below the inner portion.

3. The apparatus of claim 1, further comprising a closure member pivotally attached to one of the arms proximate the opening.

4. The apparatus of claim 1, wherein each of the arms has a widened portion defined by a protuberance extending laterally inwardly proximate a distal end portion thereof.

5. A beverage glass transport apparatus which comprises a unitary fork body comprising:

two spaced apart parallel arms with a slot defined therebetween, which provides an opening at a distal end of the fork body;

a bridge portion joining the arms together and being integrally formed therewith, the bridge portion disposed at a handle end of the fork body substantially opposite the opening; and a handle formed integrally with the bridge portion and extending outwardly therefrom, wherein each of the arms comprises an inner band proximate the slot, the inner bands being substantially flattened and having upper surfaces which cooperate to define a plane, and an outer band joined to the inner band and extending in a direction away from said plane, and wherein each of the outer bands extends downwardly from a corresponding one of the inner bands.

6. A method of holding and transporting a plurality of beverage glasses where each of said beverage glasses has a narrow base portion, an upper portion which is wider than the base portion, and a flat bottom surface, said method comprising the steps of:

placing the beverage glasses substantially in a row;

sliding a beverage glass transport apparatus, having a fork body including two spaced apart arms with a slot defined therebetween which provides an opening at a distal end of the fork body, along the base portions of the beverage glasses in a manner so as to successively receive said base portions in the slot, via the opening, until all of the beverage glasses are disposed in the slot and between the arms;

lifting the apparatus and the beverage glasses together with the beverage glasses disposed in the slot;

moving the apparatus and beverage glasses to a desired destination;

placing the beverage glasses on a flattened, substantially horizontal destination surface with the bottom surfaces of the beverage glasses contacting said destination surface; and slidably pulling the apparatus away from the beverage glasses in a manner so as to successively release the beverage glasses out of the slot via the opening;

wherein the fork body further comprises:

a bridge portion joining the arms together and being integrally formed therewith, the bridge portion disposed at a handle end of the fork body substantially opposite the opening; and a handle formed integrally with the bridge portion and extending outwardly therefrom.

* * * * *